US009534788B2

(12) United States Patent
Li et al.

(10) Patent No.: US 9,534,788 B2
(45) Date of Patent: Jan. 3, 2017

(54) AIR FUEL PREMIXER FOR LOW EMISSIONS GAS TURBINE COMBUSTOR

(71) Applicant: General Electric Company, Schenectady, NY (US)

(72) Inventors: Suhui Li, Latham, NY (US); Narendra Digamber Joshi, Schenectady, NY (US); Keith Robert McManus, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 400 days.

(21) Appl. No.: 14/243,951

(22) Filed: Apr. 3, 2014

(65) Prior Publication Data

US 2015/0285503 A1 Oct. 8, 2015

(51) Int. Cl.
*F23R 3/28* (2006.01)
*F23R 3/14* (2006.01)

(52) U.S. Cl.
CPC *F23R 3/286* (2013.01); *F23R 3/14* (2013.01)

(58) Field of Classification Search
CPC ..... F23R 3/286; F23R 3/28; F23R 3/14; F23R 3/12; F23R 3/10; F23R 3/04; F23R 3/02
USPC .. 60/783, 772, 748, 740, 734, 722; 220/86.1
See application file for complete search history.

(56) References Cited

U.S. PATENT DOCUMENTS 2,404,335 A * 7/1946 Whittle ..... F23R 3/14 431/216
4,260,367 A * 4/1981 Markowski ..... F23R 3/346 431/158
4,389,848 A * 6/1983 Markowski ..... F23R 3/34 431/352
4,845,940 A * 7/1989 Beer ..... F23C 6/045 60/732
5,505,045 A * 4/1996 Lee ..... F23D 11/107 239/424
5,638,682 A 6/1997 Joshi et al.
5,675,971 A 10/1997 Angel et al.
5,680,766 A 10/1997 Joshi et al.
5,778,676 A 7/1998 Joshi et al.
5,865,024 A 2/1999 Kress et al.
(Continued)

OTHER PUBLICATIONS

International Search Report and Written Opinion issued in connection with corresponding PCT Application No. PCT/US2015/021130 dated May 28, 2015.

(Continued)

*Primary Examiner* — Robert J Hicks
(74) *Attorney, Agent, or Firm* — Ann M. Agosti

(57) ABSTRACT

A system for premixing fuel and air prior to combustion in a gas turbine engine includes a mixing duct, a centerbody fuel injector located along a central axis of the mixing duct an outer annular swirler located adjacent an upstream end of the mixing duct for swirling air flowing therethrough in a first swirl direction and an inner annular swirler located adjacent of the mixing duct upstream end for swirling air flowing therethrough in a second swirl direction. The system includes a hub separating the inner and outer annular swirlers to permit independent rotation of an air stream therethrough and multiple hollow paths located radially outward around the centerbody fuel injector and at a radially inward side of the inner annular swirler for allowing a flow of sweeping air over the surface of the centerbody fuel injector.

15 Claims, 5 Drawing Sheets

(56) References Cited

U.S. PATENT DOCUMENTS

| | | | | |
|---|---|---|---|---|
| 6,141,967 | A | 11/2000 | Angel et al. | |
| 6,345,505 | B1 | 2/2002 | Green | |
| 6,438,961 | B2 * | 8/2002 | Tuthill | F23C 7/004 60/737 |
| 6,968,692 | B2 | 11/2005 | Chin et al. | |
| 6,993,916 | B2 | 2/2006 | Johnson et al. | |
| 7,237,384 | B2 | 7/2007 | Stuttaford et al. | |
| 7,434,401 | B2 | 10/2008 | Hayashi | |
| 7,581,396 | B2 | 9/2009 | Hsieh et al. | |
| 8,099,960 | B2 | 1/2012 | Elkady et al. | |
| 8,113,000 | B2 | 2/2012 | Laster et al. | |
| 8,171,735 | B2 | 5/2012 | Mancini et al. | |
| 2006/0021350 | A1 | 2/2006 | Sanders | |
| 2012/0186256 | A1 | 7/2012 | Dai et al. | |

OTHER PUBLICATIONS

Foglesong et al., "Coherent Anti-Stokes Raman Scattering Measurements in a Lean Premixed Gas Turbine Combustor", Available from internet: <http://home.wlu.edu/~kuehnerj/cv/isromac2000.pdf>; pp. 1-8.

* cited by examiner

AIR FUEL PREMIXER FOR LOW EMISSIONS GAS TURBINE COMBUSTOR

BACKGROUND

The present technology relates generally to an air fuel mixer for the combustor of a gas turbine engine and, in particular, to an air fuel mixer which uniformly mixes fuel and air so as to reduce NOx formed by the ignition of the fuel-air mixture and minimizes auto-ignition and flashback therein.

Generally, an air-fuel mixer for a gas turbine combustor which provides gaseous and/or liquid fuel to the mixing duct so as to be mixed with air to form a uniform air/fuel mixture. Each of the air-fuel mixers includes a mixing duct, a centerbody fuel injector located within the mixing duct, a set of inner and outer counter-rotating swirlers adjacent to the upstream end of the mixing duct, and a hub separating the inner and outer swirlers to allow independent rotation of the air flow therethrough. However, air flow passing the inner swirler expands and forms a recirculation bubble zone (vortex) around the centerbody. The fuel injected into the recirculation bubble zone tends to have a long residence time allowing liquid fuel to mix with the air flow and causes auto-ignition, thereby damaging components of the air-fuel premixer. Moreover, these dual fuel mixer designs do not include features to adequately extend fuel residence time in the mixing duct for increased fuel-air premixing for low NOx emission without causing auto-ignition or flashback. Thus, while the fuel residence time in the mixing duct must be increased for better fuel-air premixing for low NOx emission, the recirculation bubble zone must be eliminated for preventing auto-ignition and/or flashback from occurring at high power operating conditions.

There is therefore a desire for a system and method premixing fuel and air prior to combustion in a gas turbine engine which better addresses the problems of auto-ignition and flashback while maintaining an emphasis on uniformly mixing liquid and/or gaseous fuel with air so as to reduce NOx formed by the ignition of the air/fuel mixture.

BRIEF DESCRIPTION

In accordance with an example of the technology, a system for premixing fuel and air prior to combustion in a gas turbine engine includes a mixing duct having a circular cross-section defined by a wall. The system also includes a centerbody fuel injector located along a central axis of the mixing duct and extending substantially the full length of said mixing duct. Further, the system includes an outer annular swirler located adjacent an upstream end of the mixing duct and including multiple circumferentially spaced vanes oriented so as to swirl air flowing therethrough in a first swirl direction and an inner annular swirler located adjacent of the mixing duct upstream end and including multiple circumferentially spaced vanes oriented so as to swirl air flowing therethrough in a second swirl direction opposite of the first swirl direction. The system includes a hub separating said inner and outer annular swirlers to permit independent rotation of an air stream therethrough and multiple hollow paths located radially outward around the centerbody fuel injector and at a radially inward side of the inner annular swirler. The multiple hollow paths are configured to allow a flow of sweeping air over the surface of the centerbody fuel injector for removing any formation of recirculation zones about the centerbody fuel injector.

In accordance with an example of the technology, a method for premixing fuel and air prior to combustion in a gas turbine engine includes directing a first flow of compressed air into a mixing duct in a first swirl direction from an outer annular swirler located adjacent an upstream end of the mixing duct. The method also includes directing a second flow of compressed air into the mixing duct in a second swirl direction opposite the first swirl direction from an inner annular swirler located adjacent an upstream end of the mixing duct. Further, the method includes injecting fuel into the mixing duct from a centerbody fuel injector located along a central axis of the mixing duct. Furthermore, the method includes passing a flow of sweeping air over the surface of the centerbody fuel injector into the mixing duct from a plurality of hollow paths located radially outward around the centerbody fuel injector and at a radially inward side of the inner annular swirler.

In accordance with an example of the technology, a gas turbine includes an air fuel premixer including a mixing duct having a circular cross-section defined by a wall. The air fuel premixer includes a centerbody fuel injector located along a central axis of the mixing duct and extending substantially the full length of said mixing duct, an outer annular swirler located adjacent an upstream end of the mixing duct and including a plurality of circumferentially spaced vanes oriented so as to swirl air flowing therethrough in a first swirl direction, an inner annular swirler located adjacent of the mixing duct upstream end and including a plurality of circumferentially spaced vanes oriented so as to swirl air flowing therethrough in a second swirl direction opposite of the first swirl direction and a hub separating said inner and outer annular swirlers to permit independent rotation of an air stream therethrough. The air fuel premixer also includes multiple hollow paths located radially outward around the centerbody fuel injector and at a radially inward side of the inner annular swirler. The multiple hollow paths are configured to allow a flow of sweeping air over the surface of the centerbody fuel injector for removing any formation of recirculation zones about the centerbody fuel injector.

DRAWINGS

These and other features, aspects, and advantages of the present technology will become better understood when the following detailed description is read with reference to the accompanying drawings in which like characters represent like parts throughout the drawings, wherein.

DETAILED DESCRIPTION

When introducing elements of various embodiments of the present technology, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed examples.

Figure 1:
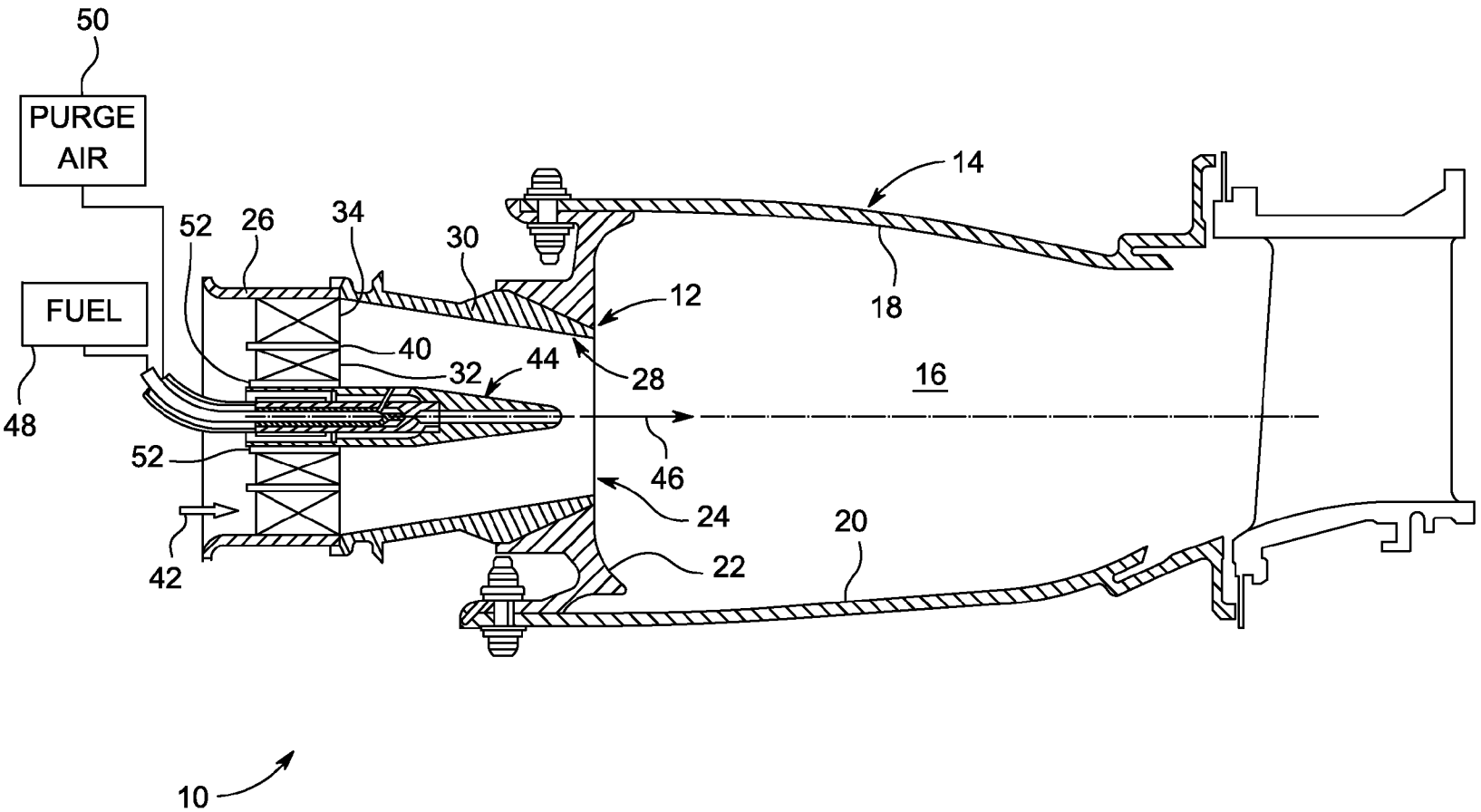
FIG. 1 shows a partial cross-sectional view through a single annular combustor structure including an air-fuel mixer in accordance with an example of the present technology.

In FIG. 1, shows a partial cross-sectional view through a single annular combustor apparatus 10 of the type suitable for use in a gas turbine engine including an air-fuel mixer 12 in accordance with an example of the present technology. The combustion apparatus 10 includes a hollow body 14 which defines a combustion chamber 16 therein. The hollow body 14 is generally annular in form and is comprised of an outer liner 18, an inner liner 20, and a domed end or dome 22. The domed end 22 of hollow body 14 includes a swirl cup 24, having disposed therein the air-fuel mixer 12 to promote the uniform mixing of fuel and air therein and the subsequent introduction of the fuel/air mixture into combustion chamber 16 with the minimal formation of pollutants caused by the ignition thereof. Further, a shroud 26 is provided which surrounds air-fuel mixer 12 at the upstream end thereof.

As shown, the air fuel mixer 12 includes a mixing duct 28 having a circular cross-section defined by an annular wall 30, an inner annular swirler 32 and an outer annular swirler 34 which are brazed or otherwise set in swirl cup 24. The mixing duct 28 allows uniform mixing of a high pressure air from a compressor (not shown) flowing through the inner and outer annular swirlers 32, 34 with fuel injected from the centerbody fuel injector 44. Inner and outer annular swirlers 32 and 34 are configured with vanes 36 and 38 (shown in FIG. 2), respectively, so as to promote counter-rotation to an air flow provided thereto (see FIG. 2). A hub 40 is utilized to separate inner and outer annular swirlers 32 and 34, which allows them to be co-annular and still separately rotate air 42 entering the upstream ends thereof. The air-fuel mixer 12 also includes a centerbody fuel injector 44 located along a central axis 46 of the mixing duct 28 and extending substantially the full length of the mixing duct 28. In one example, the centerbody fuel injector 44 is in fluid communication with a fuel supply 48 and a purge air supply 50. In another example, a portion of air 42 from the compressor may be utilized to supply air into the centerbody fuel injector 44.

The air-fuel mixer 12 also includes multiple hollow paths 52 located radially outward around the centerbody fuel injector 44 and at a radially inward side of the inner annular swirler 32. The multiple hollow paths 52 are configured to allow a flow of sweeping air over the surface of the centerbody fuel injector for removing any formation of recirculation zones about the centerbody fuel injector 44. In one example, the multiple hollow paths 52 are formed by multiple straight vanes 80 (shown in FIG. 5) disposed between the inner annular swirler 32 and the centerbody fuel injector 44. In another example, the multiple hollow paths 52 comprises multiple holes 90 (shown in FIG. 6) disposed on an inner radial portion of the vanes 36 (as shown in FIG. 2) of the inner annular swirler 32.

Figure 2:
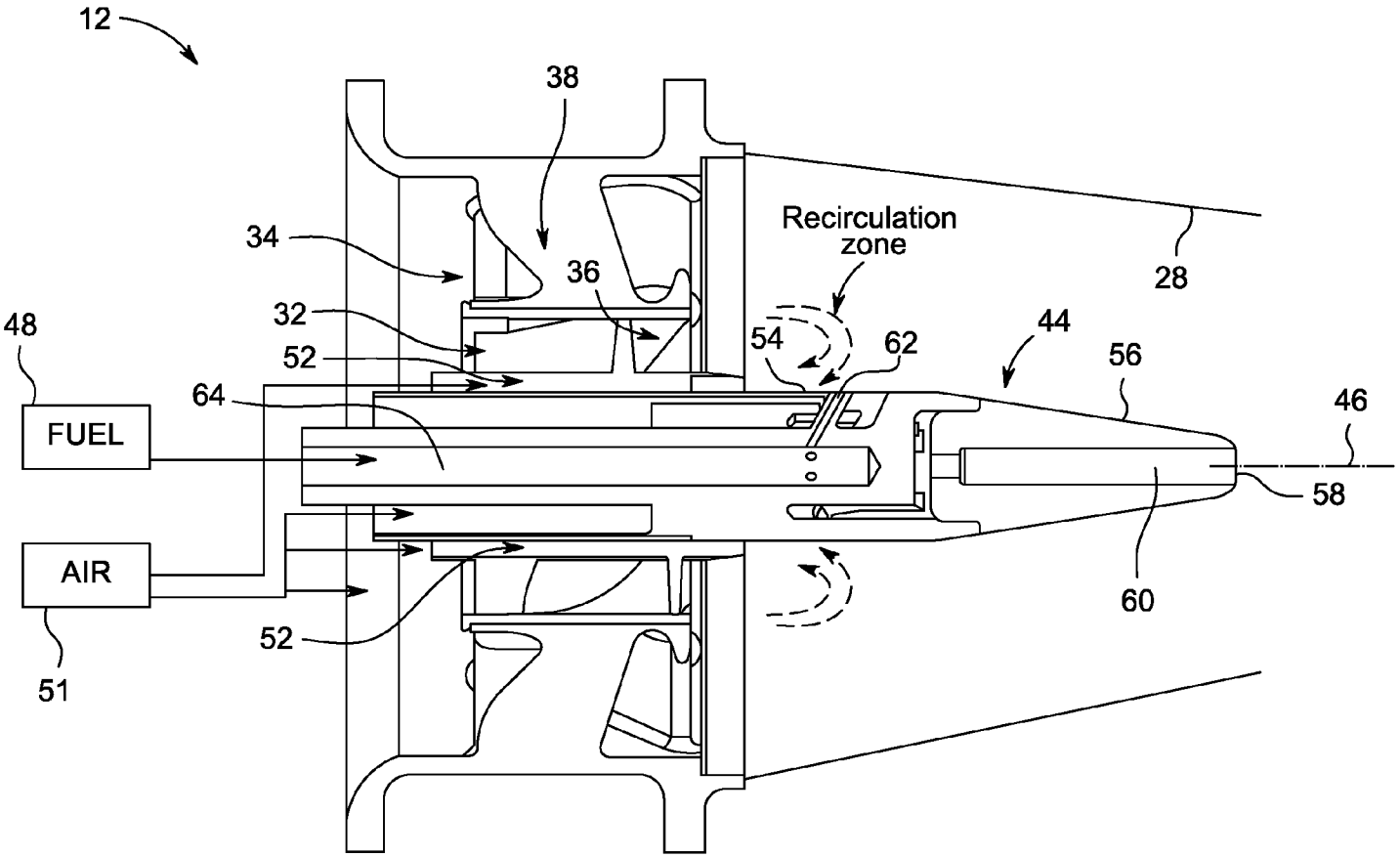
FIG. 2 is an enlarged, partial cross-sectional view of the air-fuel mixer and combustor dome portion depicted in FIG. 1 in accordance with an example of the present technology.

FIG. 2 is an enlarged, partial cross-sectional view of the air-fuel mixer 12 in accordance with an example of the present technology. The centerbody fuel injector 44 has a centerbody forward section 54 which is substantially parallel to longitudinal axis 46 passing through the air fuel mixer 12 and a centerbody aft section 56 which converges substantially uniformly to a downstream tip 58 of the centerbody fuel injector 44. The centerbody fuel injector 44 preferably includes a passage 60 through the downstream tip 58 in order to admit air of a relatively high axial velocity into combustion chamber 14 (shown in FIG. 1) adjacent the downstream tip 58. This design decreases the local fuel/air ratio to help push the flame downstream of downstream tip 58.

The centerbody fuel injector 44 further includes multiple fuel orifices 62 positioned immediately upstream of the centerbody aft section 56 from which fuel also can be injected into mixing duct 28 (shown in FIG. 1). In one example, the multiple fuel orifices 62 are preferably positioned upstream of the centerbody forward section 54. The injection of fuel through the multiple fuel orifices 62 upstream in the mixing duct 28 (shown in FIG. 1), may cause increased residence time of the fuel-air mixture, leading to sufficient mixing of fuel and air necessary for reduced NOx emission.

Further, the multiple fuel orifices 62 are spaced circumferentially about the centerbody forward section 54 and while the number and size of the multiple fuel orifices 62 is dependent on the amount of fuel supplied thereto, the pressure of the fuel, and the number and particular design of swirlers 32 and 34, it has been found that 4 to 12 orifices work adequately. Fuel is supplied to the multiple fuel orifices 62 through a fuel passage 64 within an upstream portion of the centerbody fuel injector 44. The fuel passage 64 is in turn in flow communication with a fuel supply 48 and a control mechanism, such as by means of a fuel nozzle entering the upstream portion of the centerbody fuel injector 44. It will be understood that if gaseous and liquid fuel are to be injected within fuel air mixer 12, the gas fuel will preferably be injected through passages in outer swirler 34 and the liquid fuel will be injected through the multiple fuel orifices 62.

Further, the fuel passage 64 is also associated with an air supply 51 so that air will flow through an opening 65 (shown in FIG. 4) around each of the multiple fuel orifices 62 acting as a shield layer to prevent fuel from entering the centerbody recirculation bubble zone and from staying on the surface of the centerbody fuel injector 44. When liquid fuel is not injected into the fuel passage 64, either air or gaseous fuel will be injected therein to replace liquid fuel. As shown, the air-fuel mixer 12 also includes hollow' paths 52 for providing a flow of sweeping air over the surface of the centerbody fuel injector 44 for removing completely or partially any formation of recirculation bubble zones about the centerbody fuel injector 44.

Figure 3:
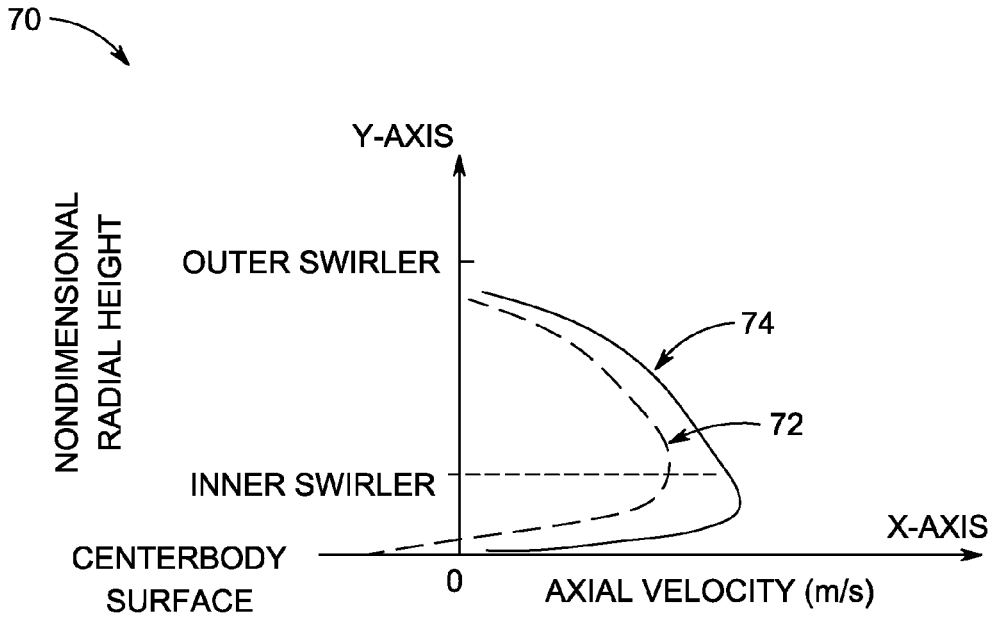
FIG. 3 shows a graph depicting a comparison of flow velocity profiles of fluids in the mixing duct around the centerbody fuel injector (shown in FIG. 1, FIG. 2) in accordance with an example of the present technology.

FIG. 3 shows a graph 70 depicting a comparison of axial flow velocity profiles of fluids at the swirler exit in the mixing duct between the present invention with multiple hollow paths located radially outward around the centerbody fuel injector and a fuel air mixer without multiple hollow paths. The major difference is around the centerbody fuel injector 44 surface (shown in FIG. 1, FIG. 2) in accordance with an example of the present technology. The graph 70 includes an axial velocity of fluids in the mixing duct in X-axis. Non-dimensional radial height of inner annular swirler and outer annular swirler are shown in Y-axis having the zero of Y-axis at centerbody surface. In absence of the hollow paths 52 (as shown in FIG. 1, FIG. 2) in a fuel air mixer, there is a formation of recirculation zone due to which there is a negative velocity profile 72 of fluids flowing around the centerbody fuel injector 44, whereas, the flow velocity profile 74 of fluids in the mixing duct 28 clearly show a positive flow velocity (going downstream of the mixing duct). This is due to the presence of the hollow paths 52 in the air-fuel mixer 12 that provides a flow of sweeping air over the surface of the centerbody fuel injector 44 thereby removing completely any formation of recirculation bubble zones about the centerbody fuel injector 44.

In operation, compressed air from a compressor (not shown) is injected into the upstream end of fuel air mixer 12 where it passes through inner and outer swirlers 32 and 34 and enters the mixing duct 28. Fuel is injected into an air flow stream exiting swirlers 32 and 34 (which includes intense shear layers in the middle area of mixing duct 28 and boundary layers along the centerbody fuel injector 44 and mixing duct wall, respectively) from fuel orifices 62 in centerbody 42. At the downstream end of mixing duct 28, the premixed fuel/air flow is supplied into a mixing region of combustor chamber 14 which is bounded by inner and outer liners 18 and 16 (shown in FIG. 1). The premixed fuel/air flow is then mixed with recirculating hot, burnt gases in combustion chamber 14 (shown in FIG. 1). In one example, the angle of the multiple fuel orifices 62 is aligned to the inner-swirling air flow angle that facilitates a fuel jets to be carried into the shear layers, thereby, promoting fuel-air mixing for reduced NOx emission.

Figure 4:
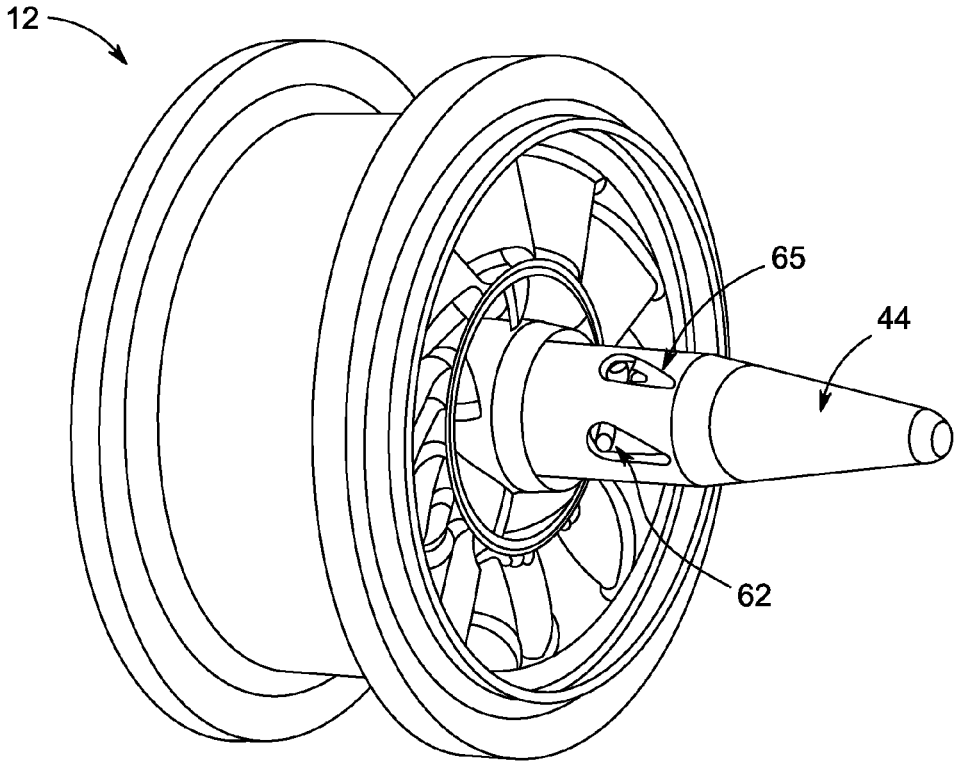
FIG. 4 is a perspective view of the air-fuel mixer 12 in accordance with an example of the present technology.

FIG. 4 is a perspective view of the air-fuel mixer 12 in accordance with an example of the present technology. As shown, the centerbody fuel injector 44 includes multiple fuel orifices 62. Each of the multiple fuel orifices 62 includes the opening 65 (shown in FIG. 4) around each of the multiple fuel orifices 62 acting as a shield layer to prevent fuel from entering the centerbody recirculation bubble zone and from staying on the surface of the centerbody fuel injector 44. This prevents auto-ignition and possible flame-holding in the mixing duct 28.

Figure 5:
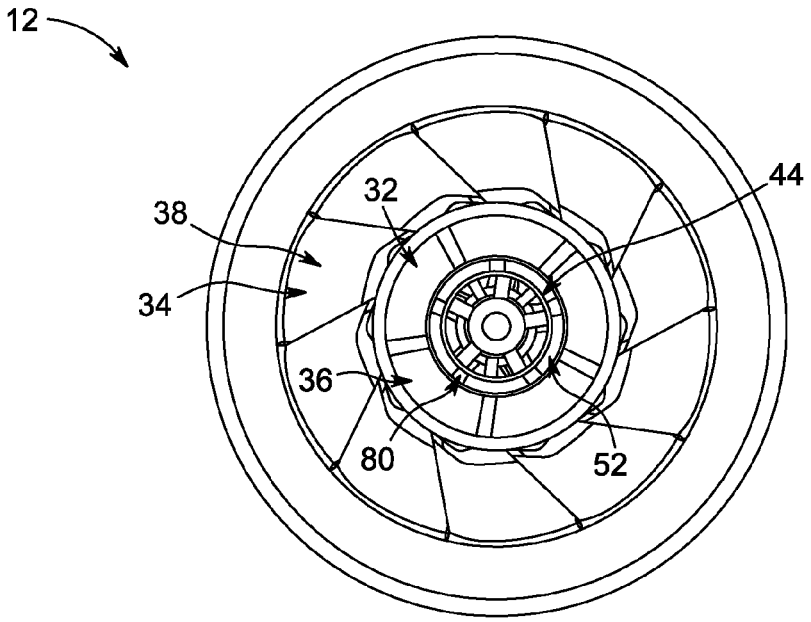
FIG. 5 is a front view of the air-fuel mixer 12 in accordance with an example of the present technology.

FIG. 5 is a front view of the air-fuel mixer 12 in accordance with an example of the present technology. As shown, the air-fuel mixer 12 includes the multiple hollow paths 52 are formed by multiple straight vanes 80 circumferentially placed between the inner swirler 32 and the centerbody fuel injector 44.

Figure 6:
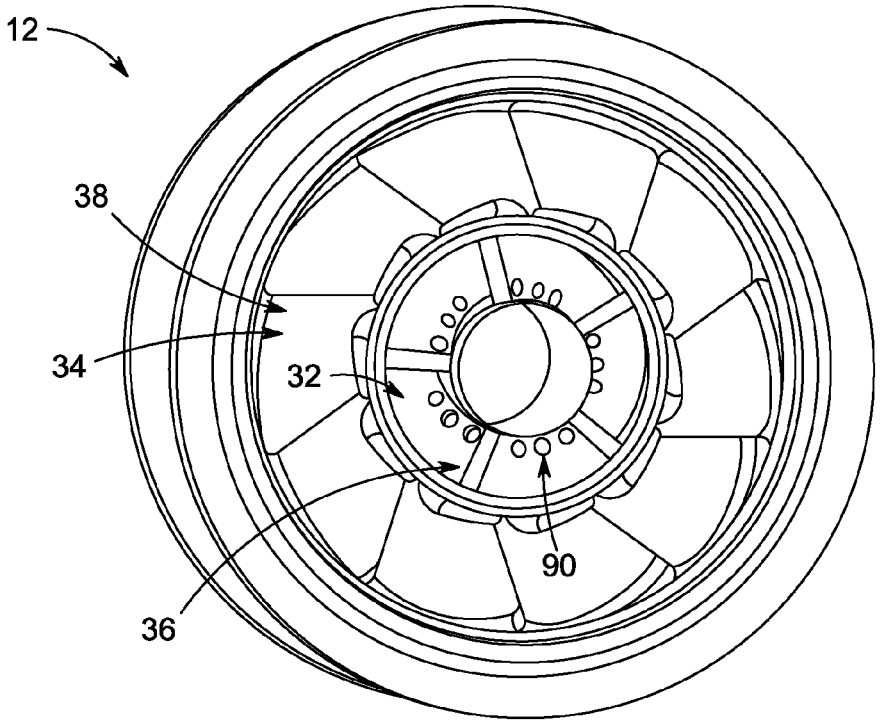
FIG. 6 is a front view of the air-fuel mixer 12 in accordance with another example of the present technology.

FIG. 6 is a front view of the air-fuel mixer 12 in accordance with another example of the present technology. As shown, the air-fuel mixer 12 includes the multiple hollow paths 90 that are multiple holes circumferentially disposed on an inner radial portion of the vanes 36 of the inner annular swirler 32.

As discussed, both the multiple hollow paths 52 formed by multiple straight vanes 80 (FIG. 5) and the multiple holes 90 (FIG. 6) provide a flow of sweeping air over the surface of the centerbody fuel injector 44 for removing completely or partially any formation of recirculation bubble zones about the centerbody fuel injector 44.

Figure 7:
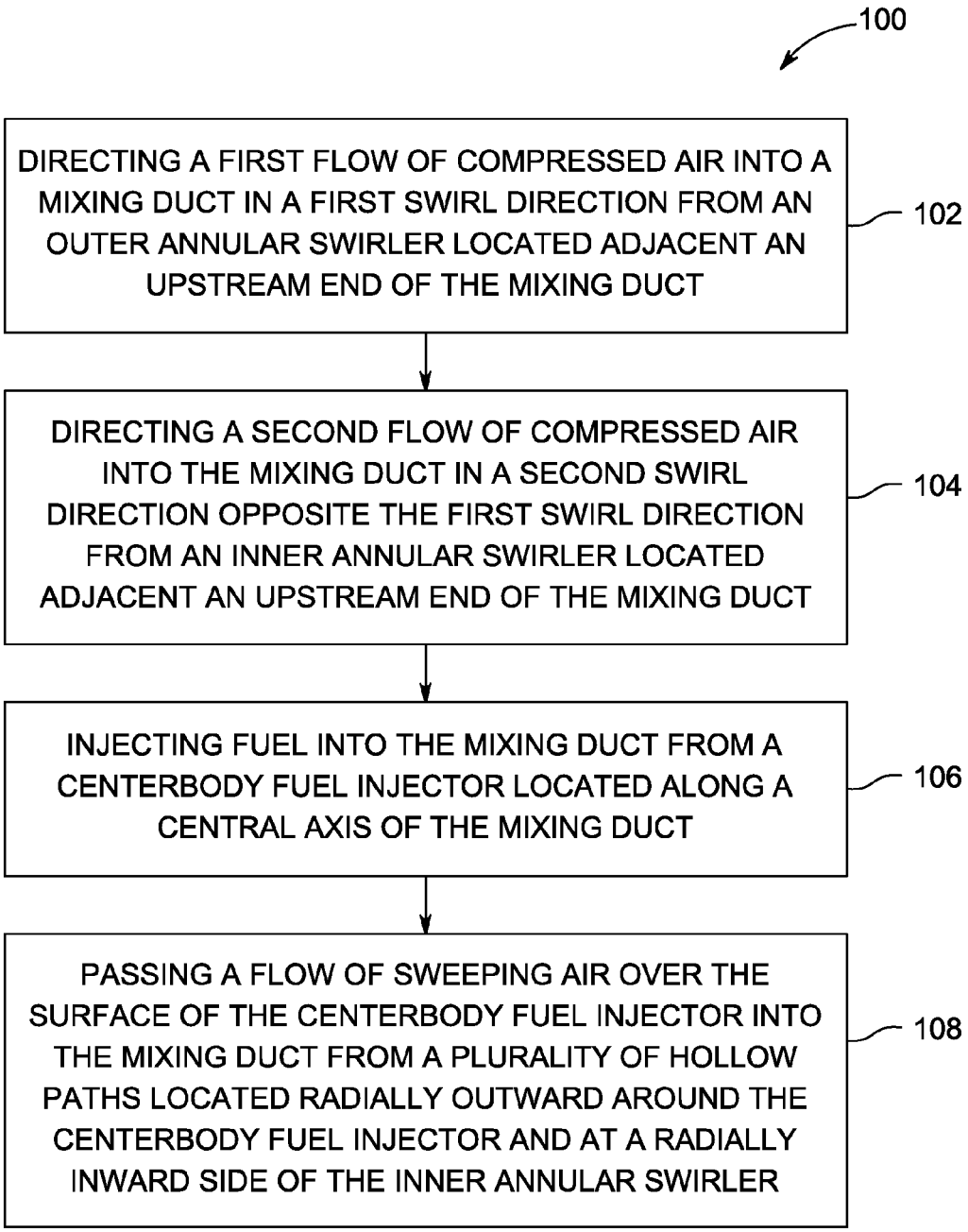
FIG. 7 is a flow chart 100 of a method of for premixing fuel and air prior to combustion in a gas turbine engine.

FIG. 7 is a flow chart 100 of a method of for premixing fuel and air prior to combustion in a gas turbine engine. At step 102, the method includes directing a first flow of compressed air into a mixing duct in a first swirl direction from an outer annular swirler located adjacent an upstream end of the mixing duct. At step 104, the method includes directing a second flow of compressed air into the mixing duct in a second swirl direction opposite the first swirl direction from an inner annular swirler located adjacent an upstream end of the mixing duct. At step 106, the method includes injecting fuel into the mixing duct from a centerbody fuel injector located along a central axis of the mixing duct. The injection of the fuel into the mixing duct is from multiple orifices disposed in the centerbody fuel injector. Each of the multiple orifices includes an injection angle that is aligned with an inner swirl vane angle of the inner annular swirler for enabling fuel penetration into a shearing layer of flows of air from the inner and outer annular swirlers. Finally at step 108, the method includes passing a flow of sweeping air over the surface of the centerbody fuel injector into the mixing duct from multiple hollow paths located radially outward around the centerbody fuel injector and at a radially inward side of the inner annular swirler for preventing formation of recirculation zone around the centerbody fuel injector. In one example, the multiple hollow paths are formed by multiple straight vanes disposed between the inner annular swirler and the centerbody fuel injector. In another example, the multiple hollow paths includes multiple holes disposed on an inner radial portion of the vanes of the inner annular swirler.

Advantageously, the present invention ensures sufficient fuel air mixing in the mixing duct thereby reducing NOx emissions. Further, the present invention prevents formation of recirculation bubble zones around the centerbody fuel injector due to the flow of sweeping air from the multiple hollow paths located radially outward around the centerbody fuel injector and at a radially inward side of the inner annular swirler. By eliminating the recirculation bubble zone, fuel orifices on the centerbody fuel injector are located upstream for better fuel air mixing. This extends the residence time of fuel inside the fuel-air mixer so that good fuel-air premixing can be achieved without causing fuel staying in the recirculation zone and preventing autoignition. The multiple hollow paths tunes the axial velocity profiles in the near-centerbody region by increasing positive axial velocity and thus eliminates the recirculation zone.

Furthermore, the skilled artisan will recognize the interchangeability of various features from different examples. Similarly, the various methods and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular example. Thus, for example, those skilled in the art will recognize that the systems and techniques described herein may be embodied or carried out in a manner that achieves or improves one advantage or group of advantages as taught herein without necessarily achieving other objects or advantages as may be taught or suggested herein.

While only certain features of the technology have been illustrated and described herein, many modifications and changes will occur to those skilled in the art. It is, therefore, to be understood that the appended claims are intended to cover all such modifications and changes as fall within the true spirit of the claimed inventions.

The invention claimed is:

1. A system for premixing fuel and air prior to combustion in a gas turbine engine, comprising:

a mixing duct having a circular cross-section defined by a wall;

a centerbody fuel injector located along a central axis of the mixing duct and extending substantially the full length of said mixing duct, an outer annular swirler located adjacent an upstream end of the mixing duct and including a plurality of circumferentially spaced vanes oriented so as to swirl air flowing therethrough in a first swirl direction;

an inner annular swirler located adjacent of the mixing duct upstream end and including a plurality of circumferentially spaced vanes oriented so as to swirl air flowing therethrough in a second swirl direction opposite of the first swirl direction;

a hub separating said inner and outer annular swirlers to permit independent rotation of an air stream therethrough; and a plurality of hollow paths located radially outward around the centerbody fuel injector and at a radially inward side of the inner annular swirler; wherein the plurality of hollow paths are configured to allow a flow of sweeping air over a surface of the centerbody fuel injector, wherein the plurality of hollow paths comprise a plurality of holes disposed in the vanes of the inner annular swirler.

2. The system of claim 1, further comprising a fuel supply in flow communication with the centerbody fuel injector.

3. The system of claim 1, wherein the plurality of hollow paths are formed by a plurality of straight vanes disposed between the inner annular swirler and the centerbody fuel injector.

4. The system of claim 1, wherein the plurality of holes are disposed on an inner radial portion of the vanes of the inner annular swirler.

5. The system of claim 1, wherein the mixing duct allows uniform mixing of a high pressure air from a compressor flowing through the inner and outer annular swirlers with a fuel from the centerbody fuel injector.

6. The system of claim 1, wherein the centerbody fuel injector comprises a plurality of orifices therein to inject fuel into said mixing duct.

7. The system of claim 6, wherein each of the plurality of orifices comprises an injection angle that is aligned with an inner swirl vane angle of the inner annular swirler for enabling fuel penetration into a shearing layer of flows of air from the inner and outer annular swirlers.

8. A method for premixing fuel and air prior to combustion in a gas turbine engine, the method comprising:

directing a first flow of compressed air into a mixing duct in a first swirl direction from an outer annular swirler located adjacent an upstream end of the mixing duct;

directing a second flow of compressed air into the mixing duct in a second swirl direction opposite the first swirl direction from an inner annular swirler located adjacent an upstream end of the mixing duct:

injecting fuel into the mixing duct from a centerbody fuel injector located along a central axis of the mixing duct; and passing a flow of sweeping air over the surface of the centerbody fuel injector into the mixing duct from a plurality of hollow paths located radially outward around the centerbody fuel injector and at a radially inward side of the inner annular swirler for preventing formation of recirculation zone around the centerbody fuel injector, wherein the plurality of hollow paths comprise a plurality of holes disposed in the vanes of the inner annular swirler.

9. The method of claim 8, further comprising injecting fuel into the mixing duct from a plurality of orifices disposed in the centerbody fuel injector.

10. The method of claim 9, wherein each of the plurality of orifices comprises an injection angle that is aligned with an inner swirl vane angle of the inner annular swirler for enabling fuel penetration into a shearing layer of flows of air from the inner and outer annular swirlers.

11. The method of claim 8, wherein the plurality of hollow paths are formed by a plurality of straight vanes disposed between the inner annular swirler and the centerbody fuel injector.

12. The method of claim 8, wherein the plurality of holes are disposed on an inner radial portion of the vanes of the inner annular swirler.

13. A gas turbine comprising:

an air fuel premixer comprising:

a mixing duct having a circular cross-section defined by a wall;

a centerbody fuel injector located along a central axis of the mixing duct and extending substantially the full length of said mixing duct, an outer annular swirler located adjacent an upstream end of the mixing duct and including a plurality of circumferentially spaced vanes oriented so as to swirl air flowing therethrough in a first swirl direction;

an inner annular swirler located adjacent of the mixing duct upstream end and including a plurality of circumferentially spaced vanes oriented so as to swirl air flowing therethrough in a second swirl direction opposite of the first swirl direction;

a hub separating said inner and outer annular swirlers to permit independent rotation of an air stream therethrough; and a plurality of hollow paths located radially outward around the centerbody fuel injector and at a radially inward side of the inner annular swirler; wherein the plurality of hollow paths are configured to allow a flow of sweeping air over the surface of the centerbody fuel injector, wherein the plurality of hollow paths comprise a plurality of holes disposed in the vanes of the inner annular swirler.

14. The gas turbine of claim 13, wherein the plurality of hollow paths are formed by a plurality of straight vanes disposed between the inner annular swirler and the centerbody fuel injector.

15. The gas turbine of claim 13, wherein the plurality of holes are disposed on an inner radial portion of the vanes of the inner annular swirler.

* * * * *